US008104539B2

(12) United States Patent
Stanojcic et al.

(10) Patent No.: US 8,104,539 B2
(45) Date of Patent: Jan. 31, 2012

(54) BOTTOM HOLE ASSEMBLY FOR SUBTERRANEAN OPERATIONS

(75) Inventors: Milorad Stanojcic, Houston, TX (US); Loyd E. East, Jr., Tomball, TX (US); Jim Surjaatmadja, Duncan, OK (US); Malcolm J. Smith, Indiana, PA (US)

(73) Assignee: Halliburton Energy Services Inc., Duncan, OK (US)

( * ) Notice: Subject to any disclaimer, the term of this patent is extended or adjusted under 35 U.S.C. 154(b) by 286 days.

(21) Appl. No.: 12/582,952

(22) Filed: Oct. 21, 2009

(65) Prior Publication Data

US 2011/0088915 A1 Apr. 21, 2011

(51) Int. Cl.
*E21B 43/26* (2006.01)

(52) U.S. Cl. ..... 166/308.1; 166/177.5

(58) Field of Classification Search ..... 166/308.1, 166/312, 177.5
See application file for complete search history.

(56) References Cited

U.S. PATENT DOCUMENTS

| | | | | |
|---|---|---|---|---|
| 5,765,642 | A | 6/1998 | Surjaatmadja | 166/297 |
| 6,394,184 | B2 | 5/2002 | Tolman et al. | 166/281 |
| 6,439,310 | B1 | 8/2002 | Scott, III et al. | 166/308 |
| 6,662,874 | B2 | 12/2003 | Surjaatmadja et al. | 166/308.6 |
| 6,719,054 | B2 | 4/2004 | Cheng et al. | 166/308.2 |
| 6,725,933 | B2 | 4/2004 | Middaugh et al. | 166/307 |
| 6,779,607 | B2 | 8/2004 | Middaugh et al. | 166/307 |
| 6,938,690 | B2 | 9/2005 | Surjaatmadja et al. | 166/242.2 |
| 7,066,265 | B2 * | 6/2006 | Surjaatmadja | 166/308.1 |
| 7,090,153 | B2 | 8/2006 | King et al. | 239/553 |
| 7,225,869 | B2 | 6/2007 | Willett et al. | 166/280.1 |
| 7,243,723 | B2 | 7/2007 | Surjaatmadja et al. | 166/278 |
| 7,278,486 | B2 * | 10/2007 | Alba et al. | 166/308.1 |
| 7,337,844 | B2 | 3/2008 | Surjaatmadja et al. | 166/308.1 |
| 7,343,975 | B2 | 3/2008 | Surjaatmadja et al. | 166/297 |
| 7,431,090 | B2 | 10/2008 | Surjaatmadja et al. | 166/308.1 |
| 7,503,404 | B2 | 3/2009 | McDaniel et al. | 175/57 |
| 7,571,766 | B2 | 8/2009 | Pauls et al. | 166/280.1 |
| 2005/0230107 | A1 * | 10/2005 | McDaniel et al. | 166/249 |
| 2005/0279501 | A1 * | 12/2005 | Surjaatmadja et al. | 166/278 |
| 2008/0047707 | A1 * | 2/2008 | Boney et al. | 166/270 |
| 2010/0044041 | A1 * | 2/2010 | Smith et al. | 166/280.1 |

FOREIGN PATENT DOCUMENTS

WO WO 2005/090747 * 9/2005

OTHER PUBLICATIONS

Search Report Issued for PCT/GB2010/001951, Jun. 24, 2011.*

* cited by examiner

*Primary Examiner* — William P Neuder
(74) *Attorney, Agent, or Firm* — John W. Wustenberg

(57) ABSTRACT

Methods and systems for stimulating a wellbore. A coil tubing bottom hole assembly is disclosed which includes a jetting tool. A non-caged ball sub is coupled to the jetting tool and a ported sub is coupled to the non-caged ball sub. Additionally, a caged ball sub is coupled to the ported sub.

17 Claims, 4 Drawing Sheets

BOTTOM HOLE ASSEMBLY FOR SUBTERRANEAN OPERATIONS

BACKGROUND

The present invention relates generally to subterranean operations, and more particularly, to methods and systems for stimulating a wellbore.

To produce hydrocarbons (e.g., oil, gas, etc.) from a subterranean formation, well bores may be drilled that penetrate hydrocarbon-containing portions of the subterranean formation. The portion of the subterranean formation from which hydrocarbons may be produced is commonly referred to as a "production zone." In some instances, a subterranean formation penetrated by the well bore may have multiple production zones at various locations along the well bore.

Generally, after a well bore has been drilled to a desired depth, completion operations are performed. Such completion operations may include inserting a liner or casing into the well bore and, at times, cementing a casing or liner into place. Once the well bore is completed as desired (lined, cased, open hole, or any other known completion), a stimulation operation may be performed to enhance hydrocarbon production into the well bore. Examples of some common stimulation operations involve hydraulic fracturing, acidizing, fracture acidizing, and hydrajetting. Stimulation operations are intended to increase the flow of hydrocarbons from the subterranean formation surrounding the well bore into the well bore itself so that the hydrocarbons may then be produced up to the wellhead.

In some applications, it may be desirable to individually and selectively create multiple fractures at a predetermined distance from each other along a wellbore by creating multiple "pay zones." In order to maximize production, these multiple fractures should have adequate conductivity. The creation of multiple pay zones is particularly advantageous when stimulating a formation from a wellbore or completing a wellbore, specifically, those wellbores that are highly deviated or horizontal. The creation of such multiple pay zones may be accomplished using a variety of tools which may include a movable fracturing tool with perforating and fracturing capabilities or actuatable sleeve assemblies disposed in a downhole tubular.

One typical formation stimulation process may involve hydraulic fracturing of the formation and placement of a proppant in those fractures. Typically, the fracturing fluid and proppant are mixed in containers at the surface before being pumped downhole in order to induce a fracture in the formation. The creation of such fractures will increase the production of hydrocarbons by increasing the flow paths in to the wellbore.

However, conventional formation stimulation techniques are capital intensive and often involve the use of specialized, high-rate blending equipment while resulting in excessive wear on pumping equipment. Additionally, the conventional methods of formation stimulation are time consuming and involve numerous steps and a number of different types of equipment for preparing and transferring the material used for stimulation down hole.

FIGURES

Some specific example embodiments of the disclosure may be understood by referring, in part, to the following description and the accompanying drawings.

Figure 1A:
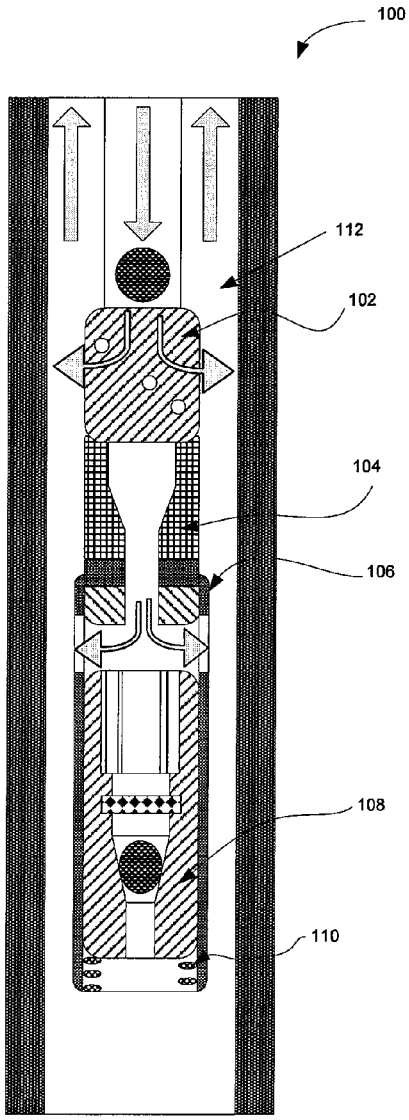
FIGS. 1A and 1B illustrate the operation of a Coil Tubing Bottom Hole Assembly in accordance with a first exemplary embodiment of the present invention.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

SUMMARY

The present invention relates generally to subterranean operations, and more particularly, to methods and systems for stimulating a wellbore.

In one exemplary embodiment, the present invention is directed to a coil tubing bottom hole assembly comprising: a jetting tool; a non-caged ball sub coupled to the jetting tool; a ported sub coupled to the non-caged ball sub; and a caged ball sub coupled to the ported sub.

In another exemplary embodiment, the present invention is directed to a method of stimulating a formation comprising: providing a coil tubing bottom hole assembly, wherein the coil tubing bottom hole assembly comprises: a jetting tool; a non-caged ball sub having a first ball coupled to the jetting tool; a ported sub coupled to the non-caged ball sub; a caged ball sub having a second ball coupled to the ported sub; and a spring coupled to the ported sub, wherein the spring is operable to open and close a port of the ported sub; placing the coil tubing bottom hole assembly at a first position in the formation; forward circulating a first fluid through the coil tubing bottom hole assembly; wherein the first fluid seals the non-caged ball sub; and wherein the first fluid closes the port of the ported sub; forward circulating a second fluid through the coil tubing bottom hole assembly when the non-caged ball sub is sealed; wherein the second fluid exits the coil tubing bottom hole assembly through the jetting tool; wherein the second fluid creates a fracture in the formation; moving the coil tubing bottom hole assembly to a second position in the formation; wherein the second position is above the first position; reverse circulating a third fluid through the coil tubing bottom hole assembly; wherein the third fluid moves the first ball out of the coil tubing bottom hole assembly; pumping a fourth fluid through the coil tubing bottom hole assembly; wherein the fourth fluid exits the coil tubing bottom hole assembly though the port of the ported sub; pumping a fifth fluid through the annulus between the coil tubing bottom hole assembly and the formation casing; mixing the fourth fluid and the fifth fluid; and treating the fracture with the mixture of the fourth fluid and the fifth fluid.

In yet another exemplary embodiment, the present invention is directed to a method of stimulating a formation comprising: providing a casing having a sleeve for removably covering one or more perforations in the casing; placing a coil tubing bottom hole assembly inside the casing, wherein the coil tubing bottom hole assembly comprises: a shifting tool engageable to the sleeve; a non-caged ball sub having a first ball coupled to the shifting tool; a ported sub coupled to the non-caged ball sub; a caged ball sub having a second ball coupled to the ported sub; and a spring coupled to the ported sub, wherein the spring is operable to open and close a port of the ported sub; placing the coil tubing bottom hole assembly at a first position in the formation; forward circulating a first fluid through the coil tubing bottom hole assembly; wherein the first fluid seals the non-caged ball sub; wherein the port of the ported sub closes when the first fluid seals the non-caged ball sub; and wherein the first fluid activates the shifting tool to engage the sleeve; moving the sleeve with the shifting tool to expose the one or more perforations; reverse circulating a second fluid through the coil tubing bottom hole assembly; wherein the second fluid moves the first ball out of the coil tubing bottom hole assembly; and wherein the second fluid disengages the shifting tool from the sleeve; moving the ported sub to a position above the one or more perforations; pumping a third fluid through the coil tubing bottom hole assembly; wherein the third fluid exits the coil tubing bottom hole assembly though the port of the ported sub; pumping a fourth fluid through the annulus between the coil tubing bottom hole assembly and the casing; mixing the third fluid and the fourth fluid; and treating the fracture with the mixture of the third fluid and the fourth fluid.

The features and advantages of the present disclosure will be readily apparent to those skilled in the art upon a reading of the description of exemplary embodiments, which follows.

DESCRIPTION

The present invention relates generally to subterranean operations, and more particularly, to methods and systems for stimulating a wellbore.

Turning now to FIG. 1, a Coil Tubing Bottom Hole Assembly (CTBHA) in accordance with a first exemplary embodiment of the present invention is denoted generally with reference numeral 100. The CTBHA includes a jetting tool 102, a non-caged ball sub 104, a ported sub 106, a caged ball sub 108 and springs 110. The end of the CTBHA 100 near the springs 110 is open. In one embodiment (not shown), the ported sub 106 may include ports configured as angled slots. In one embodiment, the jetting tool 102 may be a hydrajetting sub with nozzles. One such hydrajetting tool is disclosed in U.S. application Ser. No. 11/748,087 assigned to Halliburton Energy Services, Inc., and incorporated herein in its entirety. Moreover, as would be appreciated by those of ordinary skill in the art, with the benefit of this disclosure, the ported sub 106 may be spring activated (as shown) or an indexing-pressure activated circulation valve.

In accordance with an exemplary embodiment of the present invention, the CTBHA 100 is lowered to a predetermined fracturing interval. As would be apparent to those of ordinary skill in the art, with the benefit of this disclosure, the fracturing interval may be the deepest fracturing interval, the shallowest fracturing interval or any other interval therebetween. With the CTBHA 100 in a desired location to be stimulated, the stimulation process is initiated.

First, as depicted in FIG. 1A, a clean fluid is pumped down through the bore of the CTBHA 100. As would be appreciated by those of ordinary skill in the art, with the benefit of this disclosure, a number of suitable fluids may be used as the clean fluid. For example, the clean fluid may be most brines, including fresh water. The brines may sometimes contain viscosifying agents or friction reducers. The clean fluid may also be energized fluids such as foamed or comingled brines with carbon dioxide or nitrogen, acid mixtures or oil, based fluids and emulsion fluids. The clean fluid forward circulates the ball in the non-caged ball sub 104 and moves the ported sub 106 into the open position by compressing the springs 110. Accordingly, the clean fluid entering through the bore of the CTBHA 100 exits through the jetting tool 102 and the ported sub 106, exiting up through the annulus 112 between the CTBHA 100 and the casing. Next, before the clean fluid sets the ball into the non-caged ball sub 104, the pumping rate of the fluid through the bore of the CTBHA 100 is adjusted to the designed rate for the jetting operations. In one embodiment, the jetting operation may be a hydrajetting operation. Eventually, the pressure from the clean fluid sets the ball into the non-caged ball sub 104 as depicted in FIG. 1B.

Figure 1B:
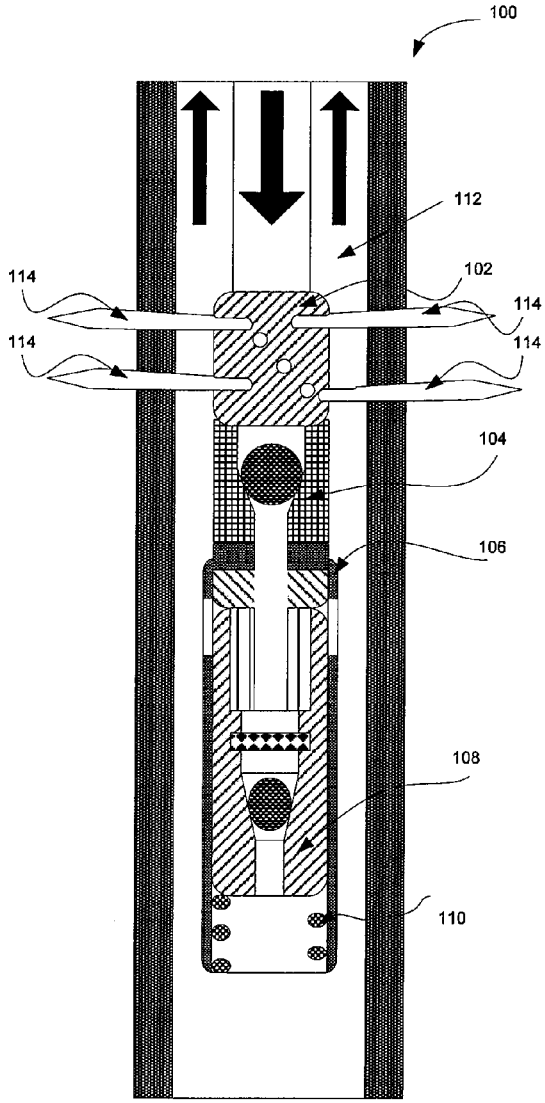

As depicted in FIG. 1B, once the ball is set into the non-caged ball sub 104, fluid flow through the portions of the CTBHA 100 below the non-caged ball sub 104 ceases and the pressure on the springs 110 is released, closing the ports of the ported sub 106. The abrasive fluid used for the jetting operations is then pumped down hole through the bore of the CTBHA 100 and exits through the jetting tool. As would be appreciated by those of ordinary skill in the art, the abrasive materials used may be sand, manmade proppants or garnet, typically 16/30 API mesh size or smaller. The jetting operations will create fractures 114 in the formation.

Figure 2A:
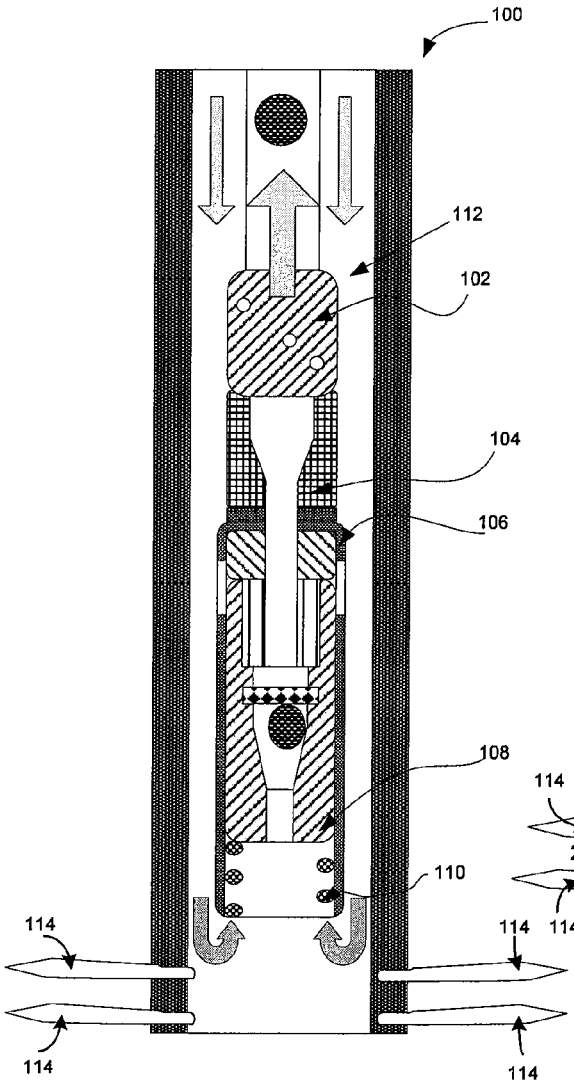
FIGS. 2A and 2B illustrate the operation of the Coil Tubing Bottom Hole Assembly of FIG. 1 in accordance with an exemplary embodiment of the present invention.

As shown in FIG. 2A, once connectivity to the desired production interval is established, the CTBHA 100 is pulled up and clean fluid is reverse-circulated through the tool. Specifically, the clean fluid is pumped down through the annulus 112 and moves up through the bore of the CTBHA 100. As depicted in FIG. 2A, the reverse circulation of the clean fluid moves up the balls in the caged ball sub 108 and the non-caged ball sub 104. The ball in the non-caged ball sub 104 is carried up and captured at the surface. During this step, the clean fluid also removes cutting sand and other materials released during the jetting operations to the surface.

Figure 2B:
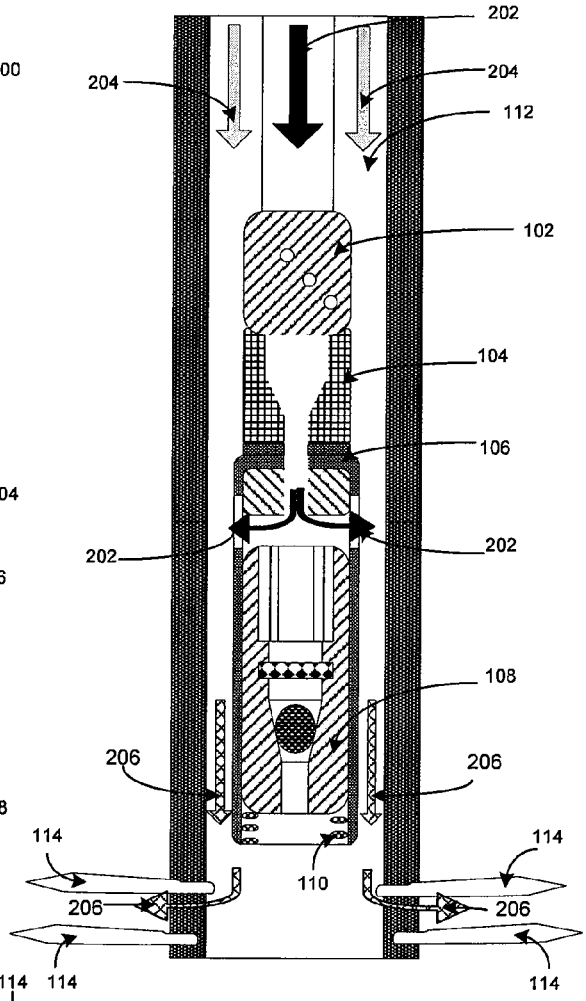

Next, as depicted in FIG. 2B, the treatment and downhole mixing step is carried out. In this step, proppant slurry 202 is pumped down through the bore of the CTBHA 100 pushing down the ball in the caged ball assembly 108, compressing the springs 110 and opening the ports of the ported sub 106. The proppant slurry 202 then exits the CTBHA 100 through the ports of the ported sub 106. At the same time, clean fluid 204 is pumped down hole through the annulus 112 and mixes with the proppant slurry 202 exiting through the ported sub 106. As would be appreciated by those of ordinary skill in the art, the proppant slurry 202 may be any fracturing fluid capable of suspending and transporting proppant in concentrations above about 12 lbs of proppant per gallon of fluid. In one exemplary embodiment, the proppant slurry may be Liquid-Sand™ material available from Halliburton Energy Services, Inc., of Duncan, Okla. and disclosed in U.S. Pat. No. 5,799,734, which is incorporated herein in its entirety. The desired proppant mixture 206 is then placed into the formation. Once the desired proppant mixture 206 is placed into the formation, the pumping rate of the proppant slurry 202 down the bore of the CTBHA 100 and the clean fluid 204 down the annulus 112 is reduced. The annulus 112 is then partially opened, controlling annulus surface pressure. Next, highly concentrated liquid sand is slowly laid down and a sand plug is set and pressure tested. The CTBHA 100 is then moved to the next interval that is to be stimulated and the same process is repeated.

The CTBHA 100 may be used for multistage stimulation of a wellbore using hydrajet perforating and high pumping rate fluid mixing. Moreover, as will be appreciated by those of ordinary skill in the art, with the benefit of this disclosure, the CTBHA 100 allows the forward and reverse circulation of fluids in and out of the wellbore.

Figure 3A:
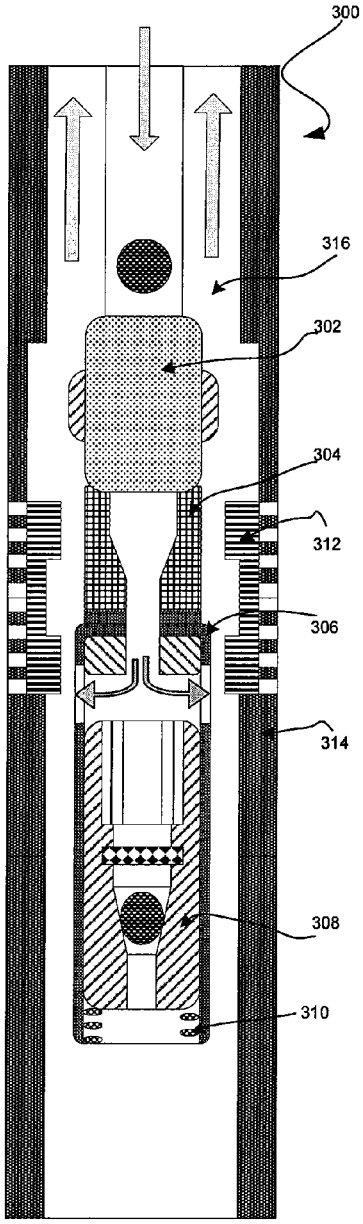
FIGS. 3A and 3B illustrate the operation of a Coil Tubing Bottom Hole Assembly in accordance with a second exemplary embodiment of the present invention.

FIG. 3A depicts a Coil Tubing Bottom Hole Assembly in accordance with a second exemplary embodiment of the present invention denoted generally with reference numeral 300. The CTBHA 300 includes a mechanical shifting tool 302, a non-caged ball sub 304, a ported sub 306, a caged ball sub 308 and springs 310. The end of the CTBHA 300 near the springs 310 is open. In one embodiment (not shown), the ported sub 106 may include ports configured as angled slots. As would be appreciated by those of ordinary skill in the art, with the benefit of this disclosure, in one embodiment, the mechanical shifting tool 302 may be replaced with a hydraulic shifting tool (not shown). Moreover, the ported sub 306 may be spring activated (as shown) or pressure activated. Additionally, the CTBHA 300 includes a sleeve 312 which is engageable to the mechanical shifting tool 302.

First, the CTBHA 300 is moved to a desired location that is to be stimulated and the sleeve 312 is in the closed position, blocking the perforations in the casing 314. Next, as depicted in FIG. 3A, a clean fluid is pumped down through the bore of the CTBHA 300. The clean fluid forward circulates the ball in the non-caged ball sub 304 and moves the ported sub 306 into the open position by compressing the springs 310. Accordingly, the clean fluid entering through the bore of the CTBHA 300 exits through the ported sub 306 and up through the annulus 316 between the CTBHA 300 and the casing 314. The CTBHA 300 is then moved down to position the mechanical shifting tool 302 near the sleeve 312. With the ball blocking off the non-caged ball sub 304, the pressure from the clean fluid activates the mechanical shifting tool 302, extending the lugs which engage the sleeve 312 as depicted in FIG. 3B.

Figure 3B:
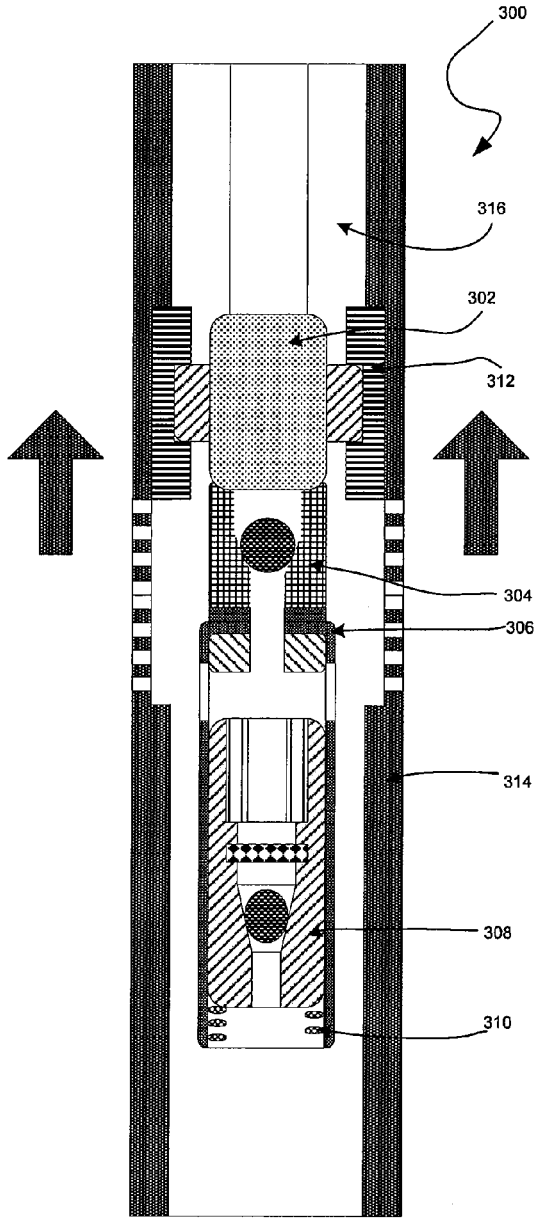

As depicted in FIG. 3B, once the mechanical shifting tool 302 has engaged the sleeve 312, the CTBHA 300 is moved up, shifting the sleeve 312 to the open position and exposing the ports in the casing 314.

Figure 4A:
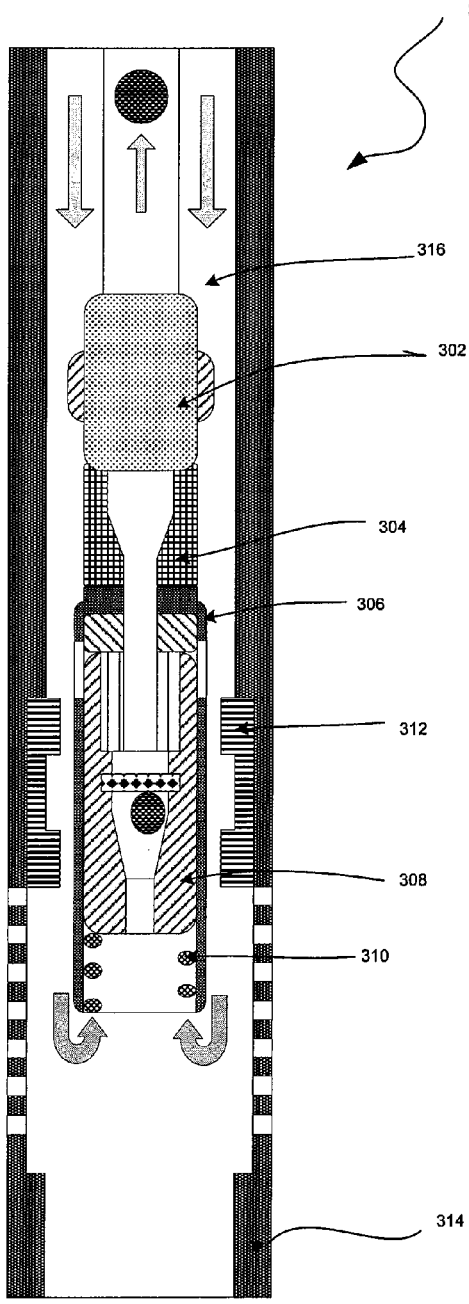
FIGS. 4A and 4B illustrate the operation of the Coil Tubing Bottom Hole Assembly of FIG. 3 in accordance with an exemplary embodiment of the present invention.

Next, after confirming the connectivity to the production interval, the CTBHA 300 is moved up as depicted in FIG. 4A, and clean fluid is reverse circulated through the CTBHA 300. Accordingly, the clean fluid is pumped downhole through the annulus 316 and moves up through the bore of the CTBHA 300, relaxing the spring 310 and moving up the ball in the caged ball sub 308. Additionally, the clean fluid moves the ball from the non-caged ball sub 304 to the surface.

Figure 4B:
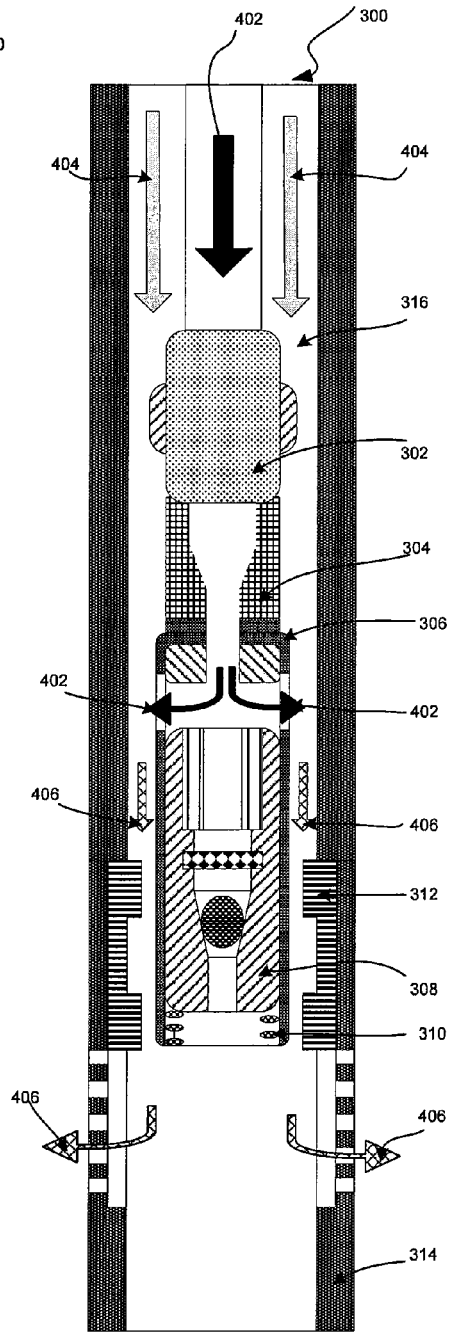

Finally, as depicted in FIG. 4B, the treatment downhole mixing step is carried out. In this step, proppant slurry 402 is pumped down through the bore of the CTBHA 300 pushing down the ball in the caged ball assembly 308, compressing the springs 310 and opening the ports of the ported sub 306. With the ball sealing the caged ball sub 308, the proppant slurry 302 then exits the CTBHA 300 through the ports of the ported sub 306. At the same time, clean fluid 404 is pumped down hole through the annulus 316 and mixes with the proppant slurry 402, with the mixture 406 exiting through the ported sub 306. As would be appreciated by those of ordinary skill in the art, the proppant slurry 402 may be any fracturing fluid capable of suspending and transporting proppant in concentrations above about 12 lbs of proppant per gallon of fluid. In one exemplary embodiment, the proppant slurry may be LiquidSand™ material available from Halliburton Energy Services, Inc., of Duncan, Okla. and disclosed in U.S. Pat. No. 5,799,734, which is incorporated herein in its entirety. The desired proppant mixture 406 is then placed into the formation. Once the desired proppant mixture 406 is placed into the formation, the pumping of the proppant slurry 402 down the bore of the CTBHA 300 and the clean fluid 404 down the annulus 316 ceases.

Finally, in one embodiment, the CTBHA 300 may be moved down (not shown) and the ball for the non-caged ball sub 304 may be forward circulated down the CTBHA 300. The ball then lands in the non-caged ball sub 304. The CTBHA 300 may then be pressured up, extending the lugs from the mechanical shifting tool 302 which engage the sleeve 312 and move it to the closed position. The CTBHA 300 may then be moved to another interval which is to be stimulated and the CTBHA may again be pressured up, extending the lugs from the mechanical shifting tool 302 which engage the sleeve 312 and move it to the open position to establish connectivity to a second productive interval to be treated.

The CTBHA may be used for multistage stimulation of a wellbore using hydrajet perforating and high pumping rate fluid mixing. Moreover, as will be appreciated by those of ordinary skill in the art, with the benefit of this disclosure, the CTBHA allows the forward and reverse circulation of fluids in and out of the wellbore.

As would be appreciated by those of ordinary skill in the art, with the benefit of this disclosure, any suitable pump may be used for pumping the clean fluid, the abrasive fluid or the proppant slurry downhole. For instance, the material may be pumped downhole using a hydraulic pump, a peristaltic pump or a centrifugal pump. Additionally, as would be appreciated by those of ordinary skill in the art, with the benefit of this disclosure, although in an exemplary embodiment, springs are used to adjust the openings of the ported sub, in another embodiment, the openings may be adjusted manually.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A coil tubing bottom hole assembly comprising:

a jetting tool;

a non-caged ball sub coupled to the jetting tool;

a ported sub coupled to the non-caged ball sub;

wherein the ported sub is located downhole relative to the non-caged ball sub;

wherein the non-caged ball sub is operable to open or close at least one port of the ported sub; and a caged ball sub coupled to the ported sub.

2. The coil tubing bottom hole assembly of claim 1, further comprising a spring operable to open and close the ported sub.

3. The coil tubing bottom hole assembly of claim 1, wherein the jetting tool is a hydrajetting tool.

4. The coil tubing bottom hole assembly of claim 1, wherein a ball of the non-caged ball sub is removable.

5. The coil tubing bottom hole assembly of claim 1, wherein the ported sub is pressure activated.

6. The coil tubing bottom hole assembly of claim 1, wherein a port of the ported sub is an angled slot.

7. The coil tubing bottom hole assembly of claim 1, wherein size of an opening of the ported sub is adjusted using a spring.

8. The coil tubing bottom hole assembly of claim 1, wherein size of an opening of the ported sub is manually adjusted.

9. A method of stimulating a formation comprising:

providing a coil tubing bottom hole assembly, wherein the coil tubing bottom hole assembly comprises:

a jetting tool;

a non-caged ball sub having a first ball coupled to the jetting tool;

a ported sub coupled to the non-caged ball sub;

a caged ball sub having a second ball coupled to the ported sub; and a spring coupled to the ported sub, wherein the spring is operable to open and close a port of the ported sub;

placing the coil tubing bottom hole assembly at a first position in the formation;

forward circulating a first fluid through the coil tubing bottom hole assembly;

wherein the first fluid seals the non-caged ball sub; and wherein the first fluid closes the port of the ported sub;

forward circulating a second fluid through the coil tubing bottom hole assembly when the non-caged ball sub is sealed;

wherein the second fluid exits the coil tubing bottom hole assembly through the jetting tool;

wherein the second fluid creates a fracture in the formation;

moving the coil tubing bottom hole assembly to a second position in the formation;

wherein the second position is above the first position;

reverse circulating a third fluid through the coil tubing bottom hole assembly;

wherein the third fluid moves the first ball out of the coil tubing bottom hole assembly;

pumping a fourth fluid through the coil tubing bottom hole assembly;

wherein the fourth fluid exits the coil tubing bottom hole assembly though the port of the ported sub;

pumping a fifth fluid through the annulus between the coil tubing bottom hole assembly and the formation casing;

mixing the fourth fluid and the fifth fluid; and treating the fracture with the mixture of the fourth fluid and the fifth fluid.

10. The method of claim 9, wherein at least one of the first fluid, the third fluid and the fifth fluid is a clean fluid.

11. The method of claim 9, wherein the second fluid is an abrasive fluid.

12. The method of claim 9, wherein the fourth fluid is a proppant slurry.

13. The method of claim 9, wherein the jetting tool is a hydrajetting tool.

14. A method of stimulating a formation comprising:

providing a casing having a sleeve for removably covering one or more perforations in the casing;

placing a coil tubing bottom hole assembly inside the casing, wherein the coil tubing bottom hole assembly comprises:

a shifting tool engageable to the sleeve;

a non-caged ball sub having a first ball coupled to the shifting tool;

a ported sub coupled to the non-caged ball sub;

a caged ball sub having a second ball coupled to the ported sub; and a spring coupled to the ported sub, wherein the spring is operable to open and close a port of the ported sub;

placing the coil tubing bottom hole assembly at a first position in the formation;

forward circulating a first fluid through the coil tubing bottom hole assembly;

wherein the first fluid seals the non-caged ball sub;

wherein the port of the ported sub closes when the first fluid seals the non-caged ball sub; an wherein the first fluid activates the shifting tool to engage the sleeve;

moving the sleeve with the shifting tool to expose the one or more perforations;

reverse circulating a second fluid through the coil tubing bottom hole assembly;

wherein the second fluid moves the first ball out of the coil tubing bottom hole assembly; and wherein the second fluid disengages the shifting tool from the sleeve;

moving the ported sub to a position above the one or more perforations;

pumping a third fluid through the coil tubing bottom hole assembly;

wherein the third fluid exits the coil tubing bottom hole assembly though the port of the ported sub;

pumping a fourth fluid through the annulus between the coil tubing bottom hole assembly and the casing;

mixing the third fluid and the fourth fluid; and treating the fracture with the mixture of the third fluid and the fourth fluid.

15. The method of claim 14, wherein the shifting tool is selected from the group consisting of a mechanical shifting tool and a hydraulic shifting tool.

16. The method of claim 14, wherein one of the first fluid, the second fluid and the fourth fluid is a clean fluid.

17. The method of claim 14, wherein the third fluid is a proppant slurry.

* * * * *